US006709762B1

(12) United States Patent
Uyama

(10) Patent No.: US 6,709,762 B1
(45) Date of Patent: Mar. 23, 2004

(54) TOILET PAPER

(76) Inventor: Shizuo Uyama, 19-12, Shinonome 1-chome, Minami-ku, Hiroshima-shi, Hiroshima 734-0022 (JP)

( * ) Notice: Subject to any disclaimer, the term of this patent is extended or adjusted under 35 U.S.C. 154(b) by 0 days.

(21) Appl. No.: 09/890,247

(22) PCT Filed: Feb. 3, 2000

(86) PCT No.: PCT/JP00/00585

§ 371 (c)(1),
(2), (4) Date: Aug. 2, 2001

(87) PCT Pub. No.: WO00/45689

PCT Pub. Date: Aug. 10, 2000

(30) Foreign Application Priority Data

Feb. 4, 1999 (JP) ..... H11-027294

(51) Int. Cl.[7] ..... B32B 23/04

(52) U.S. Cl. ..... 428/532; 428/533; 428/534; 428/536; 428/537.5; 435/177; 435/178; 435/179; 435/182; 435/262.5

(58) Field of Search ..... 428/532, 533, 428/534, 536, 537.5; 435/177, 178, 179, 182, 262.5

(56) References Cited

U.S. PATENT DOCUMENTS 3,966,543 A * 6/1976 Cayle
5,543,309 A * 8/1996 Pischel ..... 435/177
6,468,391 B1 * 10/2002 Sharyo et al. ..... 162/72

FOREIGN PATENT DOCUMENTS

JP 49--133605 * 12/1974
JP 52-70200 * 6/1977
JP 9-154766 * 6/1997

* cited by examiner

*Primary Examiner*—Leszek Kiliman
(74) *Attorney, Agent, or Firm*—Armstrong, Kratz, Quintos, Hanson & Brooks, LLP

(57) ABSTRACT

The invention provides a sewage purification assist toilet paper that carries pineapple enzyme and at least one powdery additive selected from slag, porous ore, and activated carbon. The pineapple enzyme and additive decompose salinity and chlorides contained in toilet sewage which otherwise would inhibit the growth of microorganisms used in the biological treatment of sewage taking place not only in individual septic tanks but also in public sewage systems.

7 Claims, No Drawings

TOILET PAPER

BACKGROUND OF THE INVENTION

1. Field of the Invention

The present invention relates to a toilet paper.

2. Description of the Related Art

Wastewater stored in septic tanks of toilets contains a large amount of salinity of feces and chlorides contained in detergents used to clean toilets. And wastewater flowed into the public sewer system from the individual septic tanks contains the salinity and chlorides of other domestic sewage from kitchens and baths. Disadvantageously, the salinity and chlorides tend to kill the microorganism used in the biological treatment of the sewage, or at least to inhibit its growth. This results in the failure of decomposition of organic or inorganic contaminants, thereby causing noxious odor or nuisance.

Therefore, it is essential to reduce the amount of salinity and chlorides present in the sewage. However, it is no longer easy at a sewage disposal stage because of the fact that salinity and chlorides are inseparably mixed up in a large quantity of toilet water and other domestic sewage continuously entering the public sewer system.

The present invention is directed to reduce salinity and chlorides present in the domestic sewage, and assist the biological treatment of sewage. More particularly the present invention is to provide toilet paper as means for reducing the salinity and chlorides in the sewage so that the growth of microorganism in the sewage is promoted so as to activate the biological treatment of sewage, thereby eliminating the cause of noxious odor and other nuisance.

On the other hand, the inventor has discovered that pineapple enzyme has a useful property to decompose salinity and chlorides. This discovery is combined with the idea of utilizing toilet paper for promoting the biological treatment of sewage. Otherwise, toilet paper would be thoughtlessly wasted as toilet waste. This discovery has embodied into one aspect of the present invention in which toilet paper is used as a carrier of the pineapple enzyme.

According to another aspect of the present invention the pineapple enzyme have at least one additive selected from the group of slag, porous ore and activated carbon, wherein the additive is given in a powdery form.

SUMMARY OF THE INVENTION

According to the present invention, the toilet paper is made from a material containing a mixture of pineapple enzyme and at least powdery additive selected from the group of slag, porous ore, and activated carbon. Hereinafter, the pineapple enzyme and the power are collectively called "pineapple enzyme additive".

According to another aspect of the present invention, the toilet paper includes two layers of paper, a first layer having its inner surface coated with a pineapple enzyme additive, and a second layer being a plain paper and overlaid on the coated surface of the first layer.

According to a further aspect of the present invention, the toilet paper includes two layers of paper, both layers being internally coated with a pineapple enzyme additive.

Thus, the pineapple enzyme additive carried in the toilet paper is constantly present in the wastewater discharged from toilets, and is mixed with the sewage in general.

The pineapple enzyme can act as a variety of decomposing catalysts such as dehydrogenation, decarbonation, deamination, desulfation, and dechrolination, and exhibits its decomposing ability upon salinity and chlorides contained in the sewage, thereby decomposing the salinity and chlorides into simpler elements. In addition, the pineapple enzyme converts organic substances into glucose; for example, nitride such as nitrate nitrogen is decomposed into amino acid. In this way the wastewater is purified.

The pineapple enzyme introduces a large amount of oxygen into the sewage during the decomposing process, thereby increasing the amount of oxygen dissolved in the sewage. As a result of the combination of oxygen and glucose, flavobacterium and photosynthetic bacteria grow. Thus the purification of sewage is enhanced in the sewer system. The pineapple enzyme converts ill-smelling matter like ammonia gas in a toilet waste into harmless amino acid. Inorganic portion of chlorides is combined with the pineapple enzyme.

Slag contains multi-elements such as of rare each group, vanadium group, platinum group, and these elements act as a metallic catalyst (for example, metallic complex) and promotes the decomposition of salinity and chlorides by pineapple enzyme and the elimination of noxious odor.

A powder obtained from porous ore and activated carbon adsorbs ill-smelling matter present in the sewage.

The pineapple enzyme can be used singly or in combination with at least one selected from the group of slag, porous ore, and activated carbon, wherein the selected one is used in powder so as to hold the pineapple enzyme securely. Particularly, when it is held on a powdered porous ore or activated carbon, the adsorbed ill-smelling matter such as ammonia gas is efficiently converted into harmless amino acid.

The toilet paper of the present invention can be manufactured in various ways:

(1) Pulp slurry is prepared from a mixture of pineapple enzyme and at least one in a powdery form of slag, porous ore, and activated carbon, and the slurry is processed into paper by a paper machine.

(2) Paper slug is spread out and dehydrated on a screen. Then, a mixture of pineapple enzyme and at least one in a powdery form of slag, porous ore, and activated carbon is scattered on the wet paper, and is dried.

(3) Paper slug is spread out and dehydrated on a screen. A mixture of pineapple enzyme and at least one in a powdery form of slag, porous ore, and activated carbon is suspended in water, and the suspension is sprinkled on the wet paper and the paper is dried.

(4) A finished paper is prepared. A mixture of pineapple enzyme and at least one in a powdery form of slag, porous ore, and activated carbon is suspended in water, and the suspension is sprinkled on the paper, and the paper is dried.

(5) Another sheet of paper is overlaid on the paper obtained by any of the processes mentioned above.

However, the processes are not limited to the above-mentioned ones but alternative processes are possible.

The salinity and chlorides are presupposed to include both organic and inorganic matter, and their typical examples are the salinity and chlorides contained in human feces and detergents used to clean toilets, and those contained in other domestic sewage mixing with the toilet waste.

The pineapple enzyme used in the present invention is obtained by extracting the juice of pineapple, preferably under non-oxidation conditions, and condensing or drying the extracted juice while it remains active. The resulting pineapple enzyme may be in a powdery, liquid or granular form, and is blessed with the ability to decompose a variety of high-molecular organic compounds. Therefore, there is no need for artificially synthesizing individual decomposition enzyme and extracting the juice separately, thereby reducing the production cost. Pineapple enzyme is usually used while it remains active, so that it can be used in tablets obtained by mingling it with charcoal powder or clay, or impregnating it with glucose. The form may be liquid, dry powdery or granular.

Main constituents of pineapple enzyme are listed below, and the substances upon which they act are shown in parentheses:

alcohol dehydrogenase (alcohol)
lactate dehydrogenase (lactose)
glucose 6-phosphate dehydrogenase (succharides)
aldehyde dehydrogenase (aldehyde)
L-aspartate β-semialdehyde NADP oxidoreductase (aldehyde)
glutamate dehydrogenase (amino acid)
asparatate semialdehyde-dehydrogenase (amino acid)
NADPH2-cytochrome-C-lactase (NADP)
glutathione-dehydrogenase (glutathione)
trehalose-phosphate-synthetase (succharides)
polyphosphadekinase (ATP)
ethanolamine-phosphadecytizil-transferase (CTP)
trehalose-phosphatase (succharides)
metalthio-phospho-glycerate-phosphatase (glycerine)
inulase (inulin)
β-mannositase (succharides)
uridine-nucleosidase (amino acid)
cytosine-diaminase (cytosine)
methylcysteinecyntetase (amino acid)
asparatatecyntetase (ATP)
succinate dehydrogenase (succinic acid)
aconitine hydrogenase (citric acid)
fumaratehydrogenase (malinic acid)
maleate dehyrogenase (malinic acid)
citratesynthetase (acetyle-CoA)
isocitric acid-dehydrogenase (citrate)
LSNADP-oxidactase (citrate)
monoamine-oxidactase (amine)
histaminase (amine)
pyruvate decarboxylase (oxo acid)
ATP ase (ATP)
nucleotidepyrophostase (nucleic acid)
endopolyphostase (ATP)
ATP phosphohydrolase (ATP)
orotidine 5-phosphate-decarboxilase (orotidine)
any other enzymes There is no special limitation to the amount of pineapple enzyme to be used, but it has been ascertained that about 0.01% by weight of dry toilet paper is sufficient. Preferably, the ratio should exceed 0.1%.

The slag is obtained from smelting and refining operations of iron ore or alternatively from the production of material for abrasives; for example, hematite ore. More particularly, slag is intentionally obtained in smelting and refining operations, having $SiO_2$ as a major constituent. It is usually produced in the liquid phase, and is intended to contain as much impurities and undesired matter as possible so as to avoid being incorporated in the metal to be refined. The success of refining depends upon the adequacy of slag. In the non-ferrous smelting slag is called karami. The top layer rich in metallic elements, which is formed in refining and smelting, falls in the category of slag in a broad meaning of the term. The slag used in the present invention includes this categorized slag. One species or multiple species can be used in a powdery form. The preferred grain size of the slag powder is 250 mesh or less; the finer, the better. The finer grain size of slag powder can decompose chlorides at higher speed because of the increased contact area with them. In addition, the finer powder gives smooth surfaces of the toilet paper, so that it will not spoil its touch on human skin. A preferred range of slag is in 2 to 10 part by weight to 1 to 10 parts by weight of pineapple enzyme.

Porous ore may be zeolite such as green zeolite and white zeolite. Activated carbon can be obtained from coconut meal but any others can be used if it has the property of adsorbing salinity and chlorides. These porous ore and activated carbon have high adsorbing ability because of their relatively large contact area with chlorides. However, in order to avoid unpleasant touch on the users' skin, their grain size should be finer. The amount of them should be preferably 1 to 10 parts by weight to 1 to 10 parts by weight.

The toilet paper itself is manufactured from known material in a known way by any type of paper machine. The material can be selected from wood pulp, rag or cotton pulp, plant pulp, rayon pulp, and waste papers.

Pineapple enzyme is coated or impregnated on one side of toilet paper singly or in combination with at least one powdery additive of slag, porous ore or activated carbon.

More particularly, the following processes can be taken:

Pineapple enzyme and one or more additive are added to pulp slurry, and toilet paper is manufactured from this slurry in a know way.

Pineapple enzyme and additive in powder are dispersed in water, and the suspension is scattered over wet paper on the screen for dehydration. Then, the paper is dehydrated and dried.

Pineapple enzyme and one additive are dispersed in water, and the suspension is scattered on the toilet paper prepared in a known way, and is dried.

DESCRIPTION OF PREFERRED EMBODIMENTS

The present invention will be more particularly described by way of example only:

(1) Material

Pineapple juice was extracted from the fruit of pineapple at room temperature, and dehydrated into a condense form. Then it was dried by hot air. The resulting powdery activated pineapple enzyme was impregnated with glucose by 30% by weight. In this way a pineapple enzyme agent was obtained. For slag, red slag (pink slag) obtained from stainless steel ore was used in powder. For porous ore, zeolite was used in powder. For activated carbon, coconut meal was used in powder.

(2) Manufacture of Toilet Paper

Pulp slurry was prepared, and a mixture obtained by blending the above-mentioned pineapple agent, slag, porous ore and activated carbon at the ratios shown in Table 1 was added to a dried paper by 6% or 3%. Then the slurry was spread by 114 mm in width in a known way.

TABLE 1

| | Ex. 1 | Ex. 2 | Ex. 3 | Ex. 4 | Ex. 5 |
|---|---|---|---|---|---|
| PE | 50% | 50% | 90% | 50% | 50% |
| Slag | 50% | — | — | 30% | — |
| Porous ore | — | 50% | — | 20% | 40% |
| Carbon | — | — | 10% | — | 10% |

(Note) PE: pineapple enzyme agent
Carbon: activated carbon (3) Removal of Chlorides Thirty meters (100 g) of processed toilet paper and non-processed toilet paper were respectively immersed in 100 liter of sewage obtained from a joint septic tank for 48 hours at about 30° C. in summer, wherein the sewage contains feces and other domestic waste water, having a concentration of 112 ppm chlorine ion. After 48 hours' immersion, the concentration of chlorine ion in the sewage was measured. The sewage in which each toilet paper obtained from Examples 1 to 5 was immersed was found to have a concentration of about 1 ppm chlorine ion on average, and 0.7 ppm at minimum. In contract, the sewage having the non-processed toilet paper immersed had the same concentration as before immersion; that is, a concentration of 112 ppm chlorine ion. This demonstrates that there is no difference between the pre-immersion and post-immersion. In addition, it was found that the sewage having the processed toilet paper immersed permitted mosquito and mosquito larvae to breed, and that it had no noxious odor likely to smell from ammonia, sulfide, degraded fat, and so on.

INDUSTRIAL APPLICABILITY

According to the present invention, toilet paper carries pineapple enzyme and a powdery additive selected from slag, porous ore, and activated carbon. When the toilet paper is discarded as toilet waste, the pineapple enzyme decomposes salinity, chlorides and other contaminants. As a result, the growth of microorganism used in the subsequent biological treatment of sewage is assisted, and the purification of sewage is accelerated. Under such circumstances protozoa are allowed to grow, and the source of noxious odor is eliminated. This greatly contributes to the reduction of labor and cost in the public sewage disposals.

What is claimed is:

1. A toilet paper comprising pineapple enzyme and at least one powdery additive selected from the group consisting of slag, porous ore and activated carbon.

2. The toilet paper according to claim 1, wherein the toilet paper comprises a first layer and a second layer, the first layers having its one side coated with the pineapple enzyme and at least one powdery additive selected from the group consisting of slag, porous ore and activated carbon, and the second layer free from such coating being overlaid on the coated side of the first layer.

3. The toilet paper according to claim 1, wherein the pineapple enzyme is held in at least one powdery active selected from the group consisting of slag, porous ore, and activated carbon.

4. The toilet paper according to claim 1 or 2, wherein the toilet paper contains the pineapple enzyme held in at least one of activated charcoal powder and clay, or contains the pineapple enzyme agent obtained by immersing it in glucose.

5. The toilet paper according to claim 4, wherein the pineapple enzyme agent is contained by at least 0.01% by weight to a dried toilet paper.

6. The toilet paper according to claim 5, wherein the slag is added by 2 to 10 part by weight to 1 to 10 part by weight of pineapple enzyme agent.

7. The toilet paper according to claim 5, wherein the porous ore or the activated carbon is added by 1 to 10 part by weight to 1 to 10 part by weight of the pineapple enzyme agent.

* * * * *